US009201324B2

(12) United States Patent
Qiu et al.

(10) Patent No.: US 9,201,324 B2
(45) **Date of Patent: *Dec. 1, 2015**

(54) PROCESSES FOR PRODUCING POLYESTER LATEXES VIA SOLVENT-BASED AND SOLVENT-FREE EMULSIFICATION

(75) Inventors: Shigang S. Qiu, Toronto (CA); Kimberly D. Nosella, Mississauga (CA); Tie Hwee Ng, Mississauga (CA); Santiago Faucher, Oakville (CA); Fumii Higuchi, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 505 days.

This patent is subject to a terminal disclaimer.

(21) Appl. No.: 12/707,693

(22) Filed: Feb. 18, 2010

(65) Prior Publication Data

US 2011/0200930 A1 Aug. 18, 2011

(51) Int. Cl.

| | |
|---|---|
| ***G03G 9/08*** | (2006.01) |
| ***G03G 9/087*** | (2006.01) |
| ***G03G 9/097*** | (2006.01) |

(52) U.S. Cl.

CPC ..... *G03G 9/0827* (2013.01); *G03G 9/08* (2013.01); *G03G 9/0806* (2013.01); *G03G 9/087* (2013.01); *G03G 9/0819* (2013.01); *G03G 9/08755* (2013.01); *G03G 9/08795* (2013.01); *G03G 9/08797* (2013.01); *G03G 9/09733* (2013.01)

(58) Field of Classification Search

CPC ..... G03G 9/08; G03G 9/087
USPC ..... 430/108.21, 137.14, 108.2
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,933,954 | A | 1/1976 | Gebhard et al. |
| 4,056,653 | A | 11/1977 | Gebhard et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,354,804 | A | 10/1994 | Inada et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,399,597 | A | 3/1995 | Mandel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,548,004 | A | 8/1996 | Mandel et al. |

(Continued)

FOREIGN PATENT DOCUMENTS

| | | |
|---|---|---|
| WO | WO 98/45356 | 10/1998 |
| WO | WO 00/17256 | 3/2000 |

*Primary Examiner* — Stewart Fraser
*Assistant Examiner* — Rachel Zhang
(74) *Attorney, Agent, or Firm* — MDIP LLC

(57) ABSTRACT

A process for making a latex emulsion suitable for use in a toner composition includes contacting at least one polyester resin optionally with an organic solvent to form a resin mixture, adding a primary amine, optionally a surfactant, and deionized water to the mixture.

18 Claims, 2 Drawing Sheets

(56) References Cited

U.S. PATENT DOCUMENTS

| | | | |
|---|---|---|---|
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,063,827 | A | 5/2000 | Sacripante et al. |
| 6,080,807 | A | 6/2000 | Campbell |
| 6,214,507 | B1 | 4/2001 | Sokol et al. |
| 6,512,024 | B1 | 1/2003 | Lundgard et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,064,156 | B2 | 6/2006 | Rink et al. |
| 7,385,001 | B2 | 6/2008 | Shim et al. |
| 2002/0074681 | A1 | 6/2002 | Lundgard et al. |
| 2006/0222991 | A1 | 10/2006 | Sacripante et al. |
| 2008/0026311 | A1* | 1/2008 | Mizuhata et al. ..... 430/113 |
| 2008/0107989 | A1 | 5/2008 | Sacripante et al. |
| 2008/0153027 | A1 | 6/2008 | Veregin et al. |
| 2008/0233510 | A1* | 9/2008 | Nozaki et al. ..... 430/111.4 |
| 2009/0208864 | A1 | 8/2009 | Zhou et al. |
| 2009/0246680 | A1 | 10/2009 | Chung et al. |
| 2010/0316946 | A1 | 12/2010 | Faucher |
| 2011/0097664 | A1* | 4/2011 | Nosella et al. ..... 430/137.14 |

* cited by examiner

PROCESSES FOR PRODUCING POLYESTER LATEXES VIA SOLVENT-BASED AND SOLVENT-FREE EMULSIFICATION

TECHNICAL FIELD

The present disclosure relates to the use of organic bases, in embodiments primary amines, to emulsify polyester resins using a solvent based or solvent-free process to produce latex emulsions useful in the preparation of toners, and solvent based and/or solvent-free processes for the preparation of same.

BACKGROUND

Numerous processes are within the purview of those skilled in the art for the preparation of toners. Emulsion aggregation (EA) is one such method. Emulsion aggregation toners may be used in forming print and/or xerographic images. Emulsion aggregation techniques may involve the formation of an emulsion latex of the resin particles, by heating the monomers, using a batch or semi-continuous emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,902,710; 5,910,387; 5,916,725; 5,919,595; 5,925,488, 5,977,210, 5,994,020, and U.S. Patent Application Publication No. 2008/0107989, the disclosures of each of which are hereby incorporated by reference in their entirety.

Polyester toners exhibiting low melt properties have been prepared utilizing amorphous and crystalline polyester resins as illustrated, for example, in U.S. Patent Application Publication No. 2008/0153027, the disclosure of which is hereby incorporated by reference in its entirety.

To make polyester toners, resins utilized may be emulsified into an aqueous dispersion or emulsion. Two processes are often used to emulsify the polyester resins. The first method, phase inversion emulsification (PIE), utilizes ammonium hydroxide (10 wt % $NH_3$ solution) as a neutralizing agent to react with the acid end groups on the polyester resins to form anionic groups. These anionic groups drive the formation of the emulsion, stabilize the emulsion particles in the aqueous phase and may be important in controlling the final emulsion particle size. However, ammonium hydroxide is a volatile solution of ammonia in water in which the vapors readily escape from the solution, causing the concentration of the basic solution to constantly change, thus constant measures need to be taken to ensure the correct concentration is used during the PIE process. In addition, exposure to ammonium hydroxide and its vapors can cause unsafe health conditions that can lead to chemical sensitivities for all operators when dealing with this process. Thus, extra precautions should be taken to protect operators from the caustic solution and the ammonia gas.

The second method includes a solvent-free emulsification process, formed in either a batch or extrusion process through addition of sodium hydroxide (NaOH) as a neutralizing agent for preparation of the emulsions, including a surfactant solution, water, and a thermally softened resin as illustrated, for example, in U.S. Patent Application Publication Nos. 2009/0208864 and 2009/0246680, the disclosures of each of which are hereby incorporated by reference in their entirety. However, NaOH is a strong base and nucleophile which leads to the degradation of the polyester resins. Thus tight constraints are needed to ensure this degradation does not occur.

Thus, these solventless latex emulsions have also been formed utilizing secondary amines, such as piperazine, as a neutralizing agent as illustrated, for example, in U.S. patent application Ser. No. 12/485,415, the disclosure of which is hereby incorporated by reference in its entirety, to replace the more volatile hydroxide bases conventionally utilized in these processes. Secondary amines, unlike NaOH, are miscible in the polyester resin, have a melting point of about 106° C., and can therefore act as a neutralizing agent directly in the melted resin without the need for water.

However, solventless processes can be less effective in creating resin emulsions from high molecular weight polyester resins.

Improved methods for producing toners, having optimal process conditions and less hazardous materials, remain desirable. Such processes may reduce production costs for such toners and may be environmentally friendly.

SUMMARY

Processes of the present disclosure include contacting at least one polyester resin with least one organic solvent and a phase inversion agent to form a resin mixture; adding a neutralizing agent comprising at least a primary amine to the resin mixture; dissolving the resin to form a resin solution; adding water to the mixture to provide a latex emulsion containing latex particles; and continuously recovering the latex particles.

Processes for preparing a polyester emulsion of the present disclosure also include contacting at least one polyester resin with a neutralizing agent selected from the group consisting of Tris(2-aminoethyl)amine, methylamine, ethanolamine, 1,2,4,5-Benzenetetracarboxamide, 1,2,4,5-Benzenetetramine tetrahydrochloride, 1,2-Diaminocyclohexane, 1,3-Cyclohexanebis(methylamine), 1,3-Diaminoacetone dihydrochloride monohydrate, 1,4-Diaminoanthraquinone, 1,5-Diamino-2-methylpentane, 1,9-Diaminononane, 2,2'-(Ethylenedioxy)bis(ethylamine), 2,2-Dimethyl-1,3-propanediamine, 2,3,5,6-Tetramethyl-p-phenylenediamine, 2,4,6-Trimethyl-m-phenylenediamine, 2,4,8,10-Tetraoxaspiro[5.5]undecane-3,9-dipropanamine, 2,4-Diaminotoluene, 2,5-Dichloro-p-phenylenediamine, 2,5-Dimethyl-1,4-phenylenediamine, 2,6-Diamino-4-chloropyrimidine 1-oxide, 2,6-Diaminopurine, 2,6-Diaminotoluene, 2-Aminophenyl disulfide, 3,3'-Methylenedianiline, 3,4'-Oxydianiline, 3,4-Diaminobenzophenone, 4,4'-(1,1'-Biphenyl-4,4'-diyldioxy) dianiline, 4,4'-(1,3-Phenylenediisopropylidene)bisaniline, 4,4'-(1,3-Phenylenedioxy)dianiline, 4,4'-(1,4-Phenylenediisopropylidene)bisaniline, 4,4'-(4,4'-Isopropylidenediphenyl-1,1'-diyldioxy)dianiline, 4,4'-(Hexafluoroisopropylidene)bis(p-phenyleneoxy)dianiline, 4,4'-(Hexafluoroisopropylidene)dianiline, 4,4'-Diaminobenzophenone, 4,4'-Diaminooctafluorobiphenyl, 4,4'-Methylenebis(cyclohexylamine), 4,4'-Diaminobenzanilide, 4,4'-Methylene-bis(2-chloroaniline), 4,4'-Methylenebis(2,6-diethylaniline), 4,4'-Methylenebis(2,6-dimethylaniline), 4,7,10-Trioxa-1,13-tridecanediamine, 4,9-Dioxa-1,12-dodecanediamine, 4-Aminophenyl disulfide, 4-Chloro-o-phenylenediamine, 5,5'-(Hexafluoroisopropylidene)di-o-toluidine, 6-Chloro-3,5-diamino-2-pyrazinecarboxamide, Dytek® EP diamine, Poly(1,4-butanediol)bis(4-aminobenzoate), Poly(1,4-butanediol)bis(4-aminobenzoate), p-Xylylenediamine, ethylamine, 1-benzofuran-2-amine, quinolin-4-amine, 4-aminobenzoic acid, bis-(2-aminoethyl)ether, and combinations thereof, in the absence of an organic solvent to form a mixture; melt mixing the mixture; adding a concentrated surfactant to the mixture; adding water to the mixture to provide a latex emulsion containing latex particles; optionally adding one or more additional ingredients of a toner composition to the mixture; and continuously recovering the latex particles.

A toner of the present disclosure is provided which includes at least one polyester resin; at least one primary amine; water; and optionally one or more additional ingredients of a toner composition.

BRIEF DESCRIPTION OF DRAWINGS

Various embodiments of the present disclosure will be described herein below with reference to the figures wherein.

DETAILED DESCRIPTION

Figure 1:
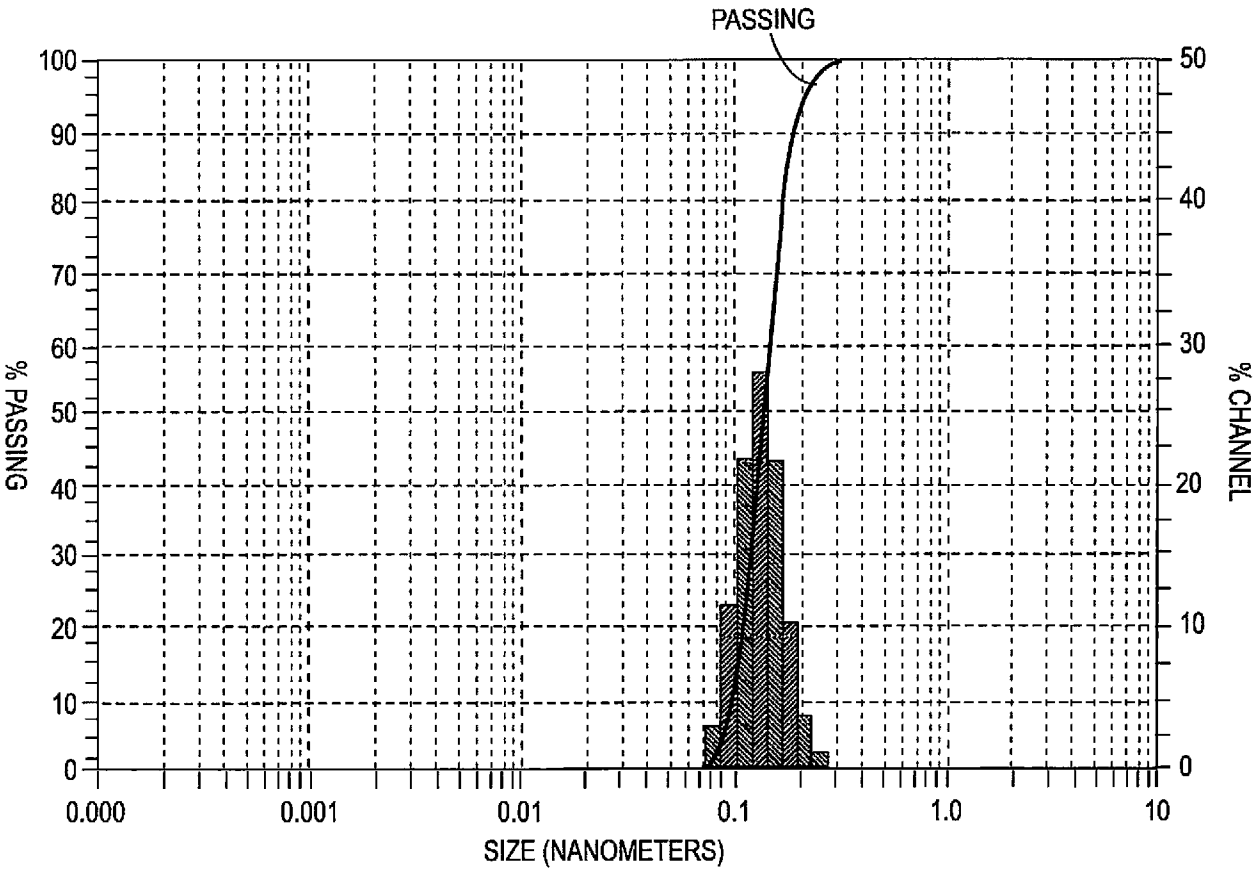
FIG. 1 is a graph depicting particle size distribution for the latex produced in accordance with Example 1 of the present disclosure.

The present disclosure provides processes for the emulsification of polyester resins to form nano-scale particles dispersed in water (i.e. an emulsion). In accordance with the present disclosure, ammonium hydroxide has been replaced as a neutralizing agent in the preparation of polyester emulsions by PIE with primary amines, such as, for example, tris-hydroxymethyl aminomethane (hereinafter referred to as "Tris") which yields practical and operational advantages. Similarly, in the solvent-free emulsification extruder processes, primary amines, such as Tris, may be utilized to substitute for NaOH to form the polyester emulsions. The use of Tris and other primary amines in lieu of hydroxide bases does not affect the performance of the emulsion or any toner produced therefrom.

In embodiments, a solvent-based phase inversion process is provided and includes contacting at least one polyester resin with least one organic solvent and a phase inversion agent to form a resin mixture; adding a neutralizing agent such as primary amines to the resin mixture; adding water to the mixture to provide a latex emulsion containing latex particles; and continuously recovering the latex particles.

The present disclosure also provides processes for producing a solvent-free latex emulsion which includes contacting at least one polyester resin with a neutralizing agent such as a primary amine, in the absence of an organic solvent to form a mixture; melt mixing the mixture; adding a concentrated surfactant to the mixture; adding water to the mixture to provide a latex emulsion containing latex particles; optionally adding one or more additional ingredients of a toner composition to the mixture; and continuously recovering the latex particles.

The present disclosure also provides a toner having at least one polyester resin; at least one primary amine; water; and optionally one or more additional ingredients of a toner composition.

Primary amines may be handled easily and safely, as they are not volatile. The primary amines are also not odorous and solutions with low concentrations may be used. Utilization of primary amines as the neutralizing agent in lieu of ammonium hydroxide may simplify and improve preparing the neutralizing solution during the phase inversion emulsification process.

Resins

Any resin may be utilized in forming a toner and processes of the present disclosure. In embodiments, the resins may be an amorphous resin, a crystalline resin, and/or a combination thereof. In embodiments, the resin may be a high molecular weight amorphous resin. In further embodiments, the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety. Suitable resins may include a mixture of high molecular and low molecular weight amorphous polyester resins.

As used herein, a high molecular weight amorphous resin may have a weight average molecular weight (Mw) of from about 35,000 to about 150,000, in embodiments from about 45,000 to about 140,000, and a low molecular weight amorphous resin may have a Mw of from about 2,000 to about 30,000, in embodiments from about 15,000 to about 25,000.

The amorphous resin may have a number average molecular weight ($M_n$), as measured by gel permeation chromatography (GPC) of, for example, from about 1,000 to about 10,000, in embodiments from about 2,000 to about 8,000. The molecular weight distribution ($M_w/M_n$) of the amorphous resin may be, for example, from about 1.5 to about 50, in embodiments from about 3 to about 25.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, in embodiments from about 42 to about 55 mole percent, in embodiments from about 45 to about 53 mole percent, and a second diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent, in embodiments from about 42 to about 52 mole percent, in embodiments from about 45 to about 50 mole percent, and a second diacid can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate). Examples of polyamides include poly(ethylene-adipamide), polypropylene-adipamide), poly(butylenes-adipamide), poly(pentylene-adipamide), poly(hexylene-adipamide), poly(octylene-adipamide), poly(ethylene-succinimide), and polypropylene-sebecamide). Examples of polyimides include poly(ethylene-adipimide), poly(propylene-adipimide), poly(butylene-adipimide), poly(pentylene-adipimide), poly(hexylene-adipimide), poly (octylene-adipimide), poly(ethylene-succinimide), poly(propylene-succinimide), and poly(butylene-succinimide).

The crystalline resin may be present, for example, in an amount of from about 3 to about 50 percent by weight of the toner components, in embodiments from about 5 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 1.5 to about 6, in embodiments from about 2 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diols selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

(I)

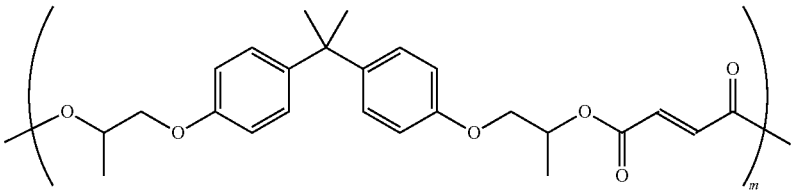

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

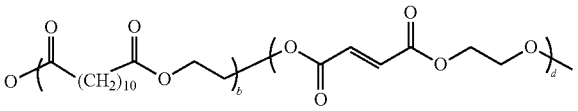

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a latex emulsion.

The amorphous resin may be present, for example, in an amount of from about 30 to about 90 percent by weight of the toner components, in embodiments from about 40 to about 80 percent by weight of the toner components. In embodiments, the amorphous resin or combination of amorphous resins utilized in the latex may have a glass transition temperature of from about 30° C. to about 80° C., in embodiments from about 35° C. to about 70° C. In further embodiments, the combined resins utilized in the latex may have a melt viscosity of from about 10 to about 1,000,000 Pa·S at about 130° C., in embodiments from about 50 to about 100,000 Pa·S.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 10% (first resin)/90% (second resin) to about 90% (first resin)/10% (second resin), Where the resin includes an amorphous resin and a crystalline resin, the weight ratio of the two resins may be from about 99% (amorphous resin):1% (crystalline resin), to about 1% (amorphous resin):90% (crystalline resin).

In embodiments the resin may possess acid groups which, in embodiments, may be present at the terminal of the resin. Acid groups which may be present include carboxylic acid groups, and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, in embodiments from about 5 mg KOH/g of resin to about 50 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Neutralizing Agent

Once obtained, the resin may be melt-mixed in solvent-free process (or dissolved in PIE process) at an elevated temperature, with a weak base or neutralizing agent added thereto. In embodiments, the base may be a solid.

In embodiments, the neutralizing agent may be used to neutralize acid groups in the resins, so a neutralizing agent herein may also be referred to as a "basic neutralization agent." Any suitable basic neutralization reagent may be used in accordance with the present disclosure. In embodiments, suitable basic neutralization agents may include both inorganic basic agents and organic basic agents. Suitable basic agents may include primary amines, such as, for example, Tris(2-aminoethyl)amine, methylamine, ethanolamine, 1,2,4,5-Benzenetetracarboxamide, 1,2,4,5-Benzenetetramine tetrahydrochloride, 1,2-Diaminocyclohexane, 1,3-Cyclohexanebis(methylamine), 1,3-Diaminoacetone dihydrochloride monohydrate, 1,4-Diaminoanthraquinone, 1,5-Diamino-2-methylpentane, 1,9-Diaminononane, 2,2'-(Ethylenedioxy) bis(ethylamine), 2,2-Dimethyl-1,3-propanediamine, 2,3,5,6-Tetramethyl-p-phenylenediamine, 2,4,6-Trimethyl-m-phenylenediamine, 2,4,8,10-Tetraoxaspiro[5.5]undecane-3,9-dipropanamine, 2,4-Diaminotoluene, 2,5-Dichloro-p-phenylenediamine, 2,5-Dimethyl-1,4-phenylenediamine, 2,6-Diamino-4-chloropyrimidine 1-oxide, 2,6-Diaminopurine, 2,6-Diaminotoluene, 2-Aminophenyl disulfide, 3,3'-Methylenedianiline, 3,4'-Oxydianiline, 3,4-Diaminobenzophenone, 4,4'-(1,1'-Biphenyl-4,4'-diyldioxy)dianiline, 4,4'-(1,3-Phenylenediisopropylidene)bisaniline, 4,4'-(1,3-Phenylenedioxy)dianiline, 4,4'-(1,4-Phenylenediisopropylidene)bisaniline, 4,4'-(4,4'-Isopropylidenediphenyl-1,1'-diyldioxy)dianiline, 4,4'-(Hexafluoroisopropylidene)bis(p-phenyleneoxy)dianiline, 4,4'-(Hexafluoroisopropylidene) dianiline, 4,4'-Diaminobenzophenone, 4,4'-Diaminooctafluorobiphenyl, 4,4'-Methylenebis (cyclohexylamine), 4,4'-Diaminobenzanilide, 4,4'-Methylene-bis(2-chloroaniline), 4,4'-Methylenebis(2,6-diethylaniline), 4,4'-Methylenebis(2,6-dimethylaniline), 4,7,10-Trioxa-1,13-tridecanediamine, 4,9-Dioxa-1,12-dodecanediamine, 4-Aminophenyl disulfide, 4-Chloro-o-phenylenediamine, 5,5'-(Hexafluoroisopropylidene)di-o-toluidine, 6-Chloro-3,5-diamino-2-pyrazinecarboxamide, Dytek® EP diamine, Poly(1,4-butanediol)bis(4-aminobenzoate), Poly(1,4-butanediol)bis(4-aminobenzoate), p-Xylylenediamine, ethylamine, 1-benzofuran-2-amine, quinolin-4-amine, 4-aminobenzoic acid, bis-(2-aminoethyl)ether, and combinations thereof.

The basic agent may be utilized so that it is present in an amount of from about 0.001% by weight to 50% by weight of the resin, in embodiments from about 0.01% by weight to about 25% by weight of the resin, in embodiments from about 0.1% by weight to 5% by weight of the resin.

In embodiments, the neutralizing agent may be utilized so that it is present in the amount of from about 50 μg to about 2000 μg, in embodiments from about 100 μg to about 1000 μg.

As noted above, the basic neutralization agent may be added to a resin possessing acid groups. The addition of the basic neutralization agent may thus raise the pH of an emulsion including a resin possessing acid groups from about 5 to about 12, in embodiments, from about 6 to about 11. The neutralization of the acid groups may, in embodiments, enhance formation of the emulsion.

Utilizing the above basic neutralization agents in combination with a resin possessing acid groups in a solvent base emulsification process, a neutralization ratio of from about 50% to about 500% may be achieved, in embodiments from about 70% to about 300%. In embodiments, the neutralization ratio may be calculated using the following equation:

Neutralization ratio in an equivalent amount of 30% Tris(g)/resin(g)/resin acid value/7.2*1000.

In embodiments, an emulsion formed in accordance with the present disclosure may also include a small quantity of water, in embodiments, de-ionized water (DIW), in amounts of from about 30% to about 95%, in embodiments, of from about 35% to about 60%, at temperatures that dissolve the resin in solvent based PIE process or melt or soften the resin in solvent-free process, of from about 25° C. to about 140° C., in embodiments from about 35° C. to about 120° C.

Unlike bases such as ammonium hydroxide, utilized in solvent-based phase inversion processes, primary amines, such as for example, Tris, can be handled easily and safely and are not volatile substances, simplifying and improving the operation of preparing the latex emulsion in the process.

In a solvent-free emulsification process, primary amines such as Tris are miscible in the polyester resin, and can therefore act as a neutralizing agent directly in the melted resin to form a homogenous mixture. In addition, primary amines do not degrade the resin as does the more volatile NaOH base. Furthermore, in embodiments, as Tris is a solid at room temperature, it can be easily pre-blended with the resin to form part of the extruder dry feed.

The properties of these primary amines, such as Tris, greatly simplify the solvent-free emulsification process as they eliminate the need for pumping fluids into the extruder, e.g. organic solvents. The pumping of fluids into extruders poses several challenges that in practice can not be completely resolved, leading to a product that is often out of the desired specification range. Sintering of feed material in the extruder feed hopper (on account of water injection and subsequent steam formation), poor ratio control of water/dry feed, plugged injection nozzles, and faulty pumps are but a few of the failure modes encountered during the production of latexes. Bases such as NaOH can also lead to differences in reaction conditions that produce materials that are out of the desired specification range (particle size, particle size distribution, resin degradation).

The substitution of NaOH by Tris and other primary amines may eliminate these processing failure modes without affecting toner performance.

In addition, the use of neutralizing agents of the present disclosure may reduce or eliminate polyester degradation (hydrolysis) observed in the production of the latex. NaOH has a $pK_a$ of 15.7 (in water) while Tris has a $pK_a$ of 8.06 (in water), thereby making NaOH a much stronger base than Tris and a strong nucleophile that can easily hydrolyze ester bonds in polyester resins, which in turn, degrades the polyester resin. Since the $pK_a$ values of carboxylic acids range from 4.7 (i.e. alkane carboxylic acids) to 4.2 (i.e. benzoic acid), a more suitable base, which approaches the strength of the acid with which it will react under controllable conditions, includes the milder, non-nucleophilic primary amine base utilized in accordance with the present disclosure.

The primary amines of the present disclosure are also more easily and safely handled compared to other liquid amine alternatives (such as piperidine, morpholine, and/or triethylamine) which may pose a spill and/or corrosion hazard. Furthermore, the primary amines are not odorous and not as toxic as piperidine or morpholine; they are easily detectable by NMR spectroscopy.

Solvent

Any suitable organic solvent may be used to dissolve the resin, for example, alcohols, esters, ethers, ketones, amines, and combinations thereof, in an amount of, for example, from about 0.1% by weight to about 99% by weight of the resin, in embodiments, from about 10% by weight to about 90% by weight of the resin, in embodiments, from about 25% by weight to about 85% by weight of the resin.

In embodiments, suitable organic solvents, sometimes referred to herein, in embodiments, as phase inversion agents, include, for example, methanol, ethanol, propanol, isopropanol, butanol, ethyl acetate, methyl ethyl ketone, and combinations thereof. In embodiments, the organic solvent may be immiscible in water and may have a boiling point of from about 30° C. to about 120° C.

Surfactants

In embodiments, the process of the present disclosure may include adding a surfactant, before or during the melt mixing, to the resin at an elevated temperature. In embodiments, the surfactant may be added prior to melt-mixing the resin at an elevated temperature. Where utilized, a resin emulsion may include one, two, or more surfactants. The surfactants may be selected from ionic surfactants and nonionic surfactants. Anionic surfactants and cationic surfactants are encompassed by the term "ionic surfactants." In embodiments, the surfactant may be added as a solid or as a concentrated solution with a concentration of from about 10% to about 100% (pure surfactant) by weight, in embodiments, from about 12% to about 95% by weight, although amounts outside these ranges may be used. In embodiments, the surfactant may be utilized so that it is present in an amount of from about 0.01% to about 20% by weight of the resin, in embodiments, from about 0.1% to about 12% by weight of the resin, in other embodiments, from about 1% to about 10% by weight of the resin, although amounts outside these ranges may be used.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenc as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108. Combinations of these surfactants and any of the foregoing surfactants may be utilized in embodiments.

Processing

The following outlines a process for phase inversion emulsification of the polyester resin. Dissolution of the resin at a certain temperature in a mixture of solvents, such as MEK and IPA;

(a) Neutralization of acid groups by adding Tris solution and/or other primary amine solution to the above resin solution;

(b) Emulsification by adding the de-ionized water to the above mixture; and (c) Removal of the solvents by evaporating the solvents at room temperature or by a vacuum distillation step at a seal reactor The desired properties of the polyester emulsion (i.e. particle size, solid content, and residual solvent level) may be achieved by adjusting the solvent ratios and neutralization ratio and process parameters (i.e., reactor temperature, vacuum, and process time).

Similarly, primary amines may also be utilized in solvent-free extrusion processes as an alternate neutralizing agent to NaOH. Primary amines are a weaker base than NaOH and thus limit the degradation of the polyester resin. Secondly, primary amines, unlike NaOH, are miscible in the resin and can act as a neutralizing agent directly in the melted resin to form a homogeneous mixture. Lastly, most primary amines, such as Tris, are a fine-grained material that are more easily and safely handled compared to ground NaOH powder.

The following outlines a process for the solvent-free process of producing a latex emulsion.

(a) Neutralization of resin acid groups by adding Tris and/or other primary amines in an extruder in the absence of an organic solvent;

(b) Melt mixing with a surfactant; and (c) Emulsification by injecting de-ionized water As used herein, "the absence of an organic solvent" includes, in embodiments, for example, that organic solvents are not utilized to dissolve the resin for emulsification. However, it is understood that minor amounts of such solvents may be present in such resins as a consequence of their use in the process of forming the latex.

As used herein, a "concentrated surfactant" includes, in embodiments, for example, a surfactant having a solids concentration of from about 10% to about 100%, in embodiments from about 12% to about 98%. However, it is understood that a lower concentration of such solids may be present in surfactants used in accordance with the present disclosure.

More than one resin may be utilized in forming the emulsion. As noted above, the resin may be an amorphous resin, a crystalline resin, or a combination thereof. In embodiments, the resin may be an amorphous resin and the elevated temperature may be a temperature above the glass transition temperature of the resin. In other embodiments, the resin may be a crystalline resin and the elevated temperature may be a temperature above the melting point of the resin. In further embodiments, the resin may be a mixture of amorphous and crystalline resins and the temperature may be above the glass transition temperature of the mixture.

Thus, in embodiments, a process of the present disclosure may include melt mixing a polyester resin with a neutralizing agent, and a concentrated surfactant, injecting deionized water to the resin mixture in order to form a latex emulsion, and continuously recovering latex particles. As noted above, suitable neutralizing agents include primary amines. In embodiments, the resins may be pre-blended prior to melt mixing.

Prior to addition, the neutralizing agent may be at any suitable temperature, including room temperature of from about 20° C. to about 25° C., or an elevated temperature, for example, the elevated temperature mentioned above.

In embodiments, the neutralizing agent may be added at a rate of from about 0.01% by weight to about 10% by weight of the resin every 10 minutes, in embodiments from about 0.1% by weight of the resin to about 5% by weight of the resin every 10 minutes, in other embodiments from about 0.5% by weight of the resin to about 4% by weight of the resin every 10 minutes. The rate of addition of the neutralizing agent need not be constant, but can be varied.

In embodiments, the neutralizing agent may be added at a rate of from about 0.4 gram/minute to about 400 kilograms/minute, in embodiments, from about 1 grams/minute to about 100 kilograms/minute.

Using these primary amines allows the extruder to operate at higher temperatures which may result in increased process throughputs.

In embodiments, the surfactant may be added to the one or more ingredients of the resin composition before, during, or after melt-mixing. In embodiments, the surfactant may be added before, during, or after the addition of the neutralizing agent. In embodiments, the surfactant may be added prior to the addition of the neutralizing agent.

In the above-mentioned heating, the elevated temperature may be from about 25° C. to about 300° C., in embodiments from about 50° C. to about 200° C., in other embodiments from about 70° C. to about 150° C.

Melt mixing may be conducted in an extruder, i.e. a twin screw extruder, a kneader such as a Haake mixer, a batch reactor, or any other device capable of intimately mixing viscous materials to create near homogenous mixtures.

Once the resins, neutralizing agent and optional surfactant are melt mixed, the mixture may then be contacted with water, to form a latex emulsion. Water may be added in order to form a latex with a solids content of from about 5% to about 50%, in embodiments, of from about 10% to about 40%. While higher water temperatures may accelerate the dissolution process, latexes may be formed at temperatures as low as room temperature. In other embodiments, water temperatures may be from about 40° C. to about 110° C., in embodiments, from about 50° C. to about 100° C.

Contact between the water and the resin mixture may be achieved in any suitable manner, such as in a vessel or continuous conduit.

Water may be added to the resin mixture at a rate of about 10 grams/minute to about 10 kilograms/minute, in embodiments from about 100 grams/minute to about 1 kilogram/minute.

In the phase inversion process, the process of making the latex emulsion may include contacting at least one resin with an organic solvent and a phase inversion agent, heating the resin mixture to an elevated temperature, stirring the mixture, adding a neutralizing agent to neutralize the acid groups of the resin, and adding water into the mixture until phase inversion occurs to form a phase inversed latex emulsion.

In the above-mentioned process, the amorphous and/or crystalline polyester resins may be dissolved in a low boiling organic solvent, which solvent is immiscible or partially miscible in water, such as ethyl acetate, methyl ethyl ketone, or any other solvent noted hereinabove, at a concentration of from about 1% by weight to about 75% by weight of resin in solvent, in embodiments from about 5% by weight to about 60% by weight of resin in solvent. The resin mixture is then heated to a temperature of from about 25° C. to about 150° C., in embodiments from about 30° C. to about 85° C. The heating need not be held at a constant temperature, but may be varied. For example, the heating may be slowly or incrementally increased during heating until a desired temperature is achieved.

The polyester latex is obtained using a two solvent PIE process which requires dispersing and solvent stripping steps. In this process, the at least one polyester resin is dissolved by a combination of two organic solvents, in embodiments MEK and IPA, to produce a homogenous organic phase. A fixed amount of base solution (such as Tris) is then added into this organic phase to neutralize acid end groups on the polyester chain, followed by the addition of de-ionized water to form a uniform dispersion of polyester particles in water through phase inversion. The organic solvents remain in both the polyester particles and water phase at this stage. Through vacuum distillation, the solvents are stripped off.

In other embodiments, as noted above, the PIE process may run in the absence of a solvent. In embodiments, the neutralizing agent which may be utilized includes the agents mentioned hereinabove. In embodiments, the optional surfactant utilized may be any of the surfactants mentioned hereinabove to ensure that proper resin neutralization occurs and leads to a high quality latex with low coarse content.

In embodiments, a continuous phase inversed emulsion may be formed. Phase inversion can be accomplished by continuing to add an aqueous alkaline solution or basic agent, optional surfactant and/or water compositions, to create a phase inversed emulsion including a disperse phase including droplets possessing the molten ingredients of the resin composition, and a continuous phase including the surfactant and/or water composition.

Dissolution may be conducted in a glass kettle with an anchor blade impeller, or any other device capable of intimately mixing viscous materials to create near homogenous mixtures.

Stirring, although not necessary, may be utilized to enhance formation of the latex. Any suitable stirring device may be utilized. In embodiments, the stirring may be at from about 10 revolutions per minute (rpm) to about 5,000 rpm, in embodiments from about 20 rpm to about 2,000 rpm, in other embodiments from about 50 rpm to about 1,000 rpm. The stirring need not be at a constant speed, but may be varied. For example, as the heating of the mixture becomes more uniform, the stirring rate may be increased. In embodiments, a homogenizer (that is, a high shear device), may be utilized to form the phase inversed emulsion, but in other embodiments, the process of the present disclosure may take place without the use of a homogenizer. Where utilized, a homogenizer may operate at a rate of from about 3,000 rpm to about 10,000 rpm.

Although the point of phase inversion may vary depending on the components of the emulsion, the temperature of heating, the stirring speed, and the like, phase inversion may occur when basic neutralization agent, optional surfactant, and/or water has been added so that the resulting resin is present in an amount from about 5% by weight to about 70% by weight of the emulsion, in embodiments from about 10% by weight to about 65% by weight of the emulsion, in other embodiments from about 15% by weight to about 60% by weight of the emulsion.

Following phase inversion, additional surfactant, water, and/or aqueous alkaline solution may optionally be added to dilute the phase inversed emulsion, although this is not required. Following phase inversion, the phase inversed emulsion may be cooled to room temperature, for example from about 20° C. to about 25° C.

In embodiments, distillation with stirring of the organic solvent is performed to provide resin emulsion particles with an average diameter size of, for example, in embodiments from about 50 nm to about 500 nm, in other embodiments from about 120 to about 250 nanometers.

The emulsified resin particles in the aqueous medium may have a submicron size, for example, of from about 500 nm or less, such as of from about 10 nm to about 500 nm, in embodiments from about 50 nm to about 400 nm, in other embodiments from about 100 nm to about 300 nm, in some embodiments about 200 nm.

The particle size distribution of a latex of the present disclosure may be from about 30 nm to about 500 nm, in embodiments, from about 80 nm to about 400 nm.

In accordance with the present disclosure, it has been found that the processes herein may produce emulsified resin particles that retain the same molecular weight properties of the starting resin, including equivalent charging and fusing performance.

The latex emulsions of the present disclosure may then be utilized to produce particles that are suitable for emulsion aggregation ultra low melt processes.

Toner

Once the resin mixture has been contacted with water to form an emulsion as described above, the resulting latex may then be utilized to form a toner by any method within the purview of those skilled in the art. The latex emulsion may be contacted with a colorant, optionally in a dispersion, and other additives to form an ultra low melt toner by a suitable process, in embodiments, an emulsion aggregation and coalescence process.

In embodiments, the optional additional ingredients of a toner composition including colorant, wax, and other additives, may be added before, during or after melt mixing the resin to form the self-emulsifying granules. The additional ingredients may be added before, during or after formation of the latex emulsion, wherein the self-emulsifying granule is contacted with water. In further embodiments, the colorant may be added before the addition of the surfactant.

Colorants

As the colorant to be added, various known suitable colorants, such as dyes, pigments, mixtures of dyes, mixtures of pigments, mixtures of dyes and pigments, and the like, may be included in the toner. In embodiments, the colorant may be included in the toner in an amount of, for example, about 0.1 to about 35% by weight of the toner, or from about 1 to about 15% by weight of the toner, or from about 3 to about 10% by weight of the toner, although the amount of colorant can be outside of these ranges.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850:1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido)phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1% by weight to about 35% by weight of the toner particles on a solids basis, in other embodiments, from about 5% by weight to about 25% by weight. However, amounts outside these ranges can also be used, in embodiments.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1% by weight to about 25% by weight of the toner particles, in embodiments from about 5% by weight to about 20% by weight of the toner particles, although the amount of wax can be outside of these ranges.

When a wax dispersion is used, the wax dispersion may include any of the various waxes conventionally used in emulsion aggregation toner compositions. Waxes that may be selected include waxes having, for example, an average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent such as polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and the like, and mixtures thereof.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0% to about 10% by weight, in embodiments from about 0.2% to about 8% by weight, in other embodiments from about 0.5% to about 5% by weight, of the resin in the mixture, although the amount of aggregating agent can be outside of these ranges. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

The toner of the present disclosure may have a particle size of from about 2 microns to about 10 microns, in embodiments of from about 3 microns to about 8 microns.

The toner of the present disclosure may have a volume average particle size distribution of from about 1 to about 1.8, in embodiments of from about 1.2 to about 1.6, a number average particle size distribution index of from about 1 to about 1.8, in embodiments of from about 1.2 to about 1.6, and a circularity of from about 0.6 to about 1.0, in embodiments of from about 0.8 to about 0.998.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a polyester amorphous resin latex as described above may be included in the shell. In yet other embodiments, the polyester amorphous resin latex described above may be combined with a resin that may be utilized to form the core, and then added to the particles as a resin coating to form a shell.

In embodiments, resins which may be utilized to form a shell include, but are not limited to, a crystalline resin latex described above, and/or the amorphous resins described above for use as the core. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the solvent free polyester resin latex or the solvent-based polyester resin latex neutralized with Tris described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10% by weight of the toner, in embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1% by weight to about 5% by weight of the toner, in embodiments of from about 0.25% by weight to about 3% by weight of the toner, although the amount of additives can be outside of these ranges. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000, 3,800,588, and 6,214,507, the disclosures of each of which are hereby incorporated by reference in their entirety.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Phase inversion emulsification of a high molecular weight amorphous resin. A 1 Liter glass kettle was charged with about 200 grams of methyl ethyl ketone (MEK), about 30 grams of isopropanol (IPA), and about 200 grams of an ethoxylated bisphenol-A based amorphous polyester resin with an acid value (AV) of about 15.2. The ratio of resin to MEK to IPA was about 10:10:1.5. The glass kettle was placed inside a water bath set at about 45° C. with its cover on, a gasket, a condenser, and an anchor blade impeller for stirring.

The resin was heated to about 42° C. with stirring of about 60 rpm. The mixture was left to stir for about 150 minutes. Once the resin was dissolved, the mixing speed was increased to about 100 rpm, and about 16.4 grams of 30% Tris solution was added to the mixture drop-wise with a disposable pipette through a rubber stopper for a period of about 2 minutes. The amount of Tris solution was estimated based on the neutralization ratio of about 75% according to the following equation:

Neutralization ratio in an equivalent amount of 30% Tris/resin(g)/resin acid value/7.2*1000.

The ratio of Tris to resin was about 2.46 pph. The mixture was then left to stir for about 10 minutes. Thereafter, about 600 grams of de-ionized water (DIW) at room temperature was pumped into the kettle at a flow rate of about 4.4 grams/minute. The emulsion produced had a particle size of about 132.5 nm (see FIG. 1) as measured using a Nanotrac particle size analyzer. The emulsion/solvent solution was then discharged from the 1 liter kettle into a glass pan, which was kept in a fume hood and stirred by a magnetic stir-bar to evaporate the solvents.

A control sample was produced using ammonium hydroxide instead of Tris.

Table 1 compares the molecular weights of the resins processed via PIE using ammonium hydroxide and Tris. Under the same process conditions, the use of Tris in lieu of ammonium hydroxide did not degrade the resin. The molecular weights of the raw resins (before the emulsification) are listed in the table.

TABLE 1

Comparison of resin molecular weights prior to and following emulsification in PIE process using ammonium hydroxide and Tris

| | Neutralizing | Molecular Weight (kg/mol) | | % Degraded | |
|---|---|---|---|---|---|
| | Agent | Mw | Mn | on Mw | on Mn |
| Raw resin lot#1 | Not applicable | 136.9 | 5.1 | 0 | 0 |
| Control sample | Ammonium hydroxide | 133.5 | 5 | 2 | 2 |
| Raw resin lot#2 | Not applicable | 129.5 | 5.3 | 0 | 0 |
| Example 1 | Tris | 137.1 | 5.2 | 0 | 2 |

Example 2

Solvent free emulsification of amorphous high molecular weight resin via extrusion using Tris neutralizing agent.

Figure 2:
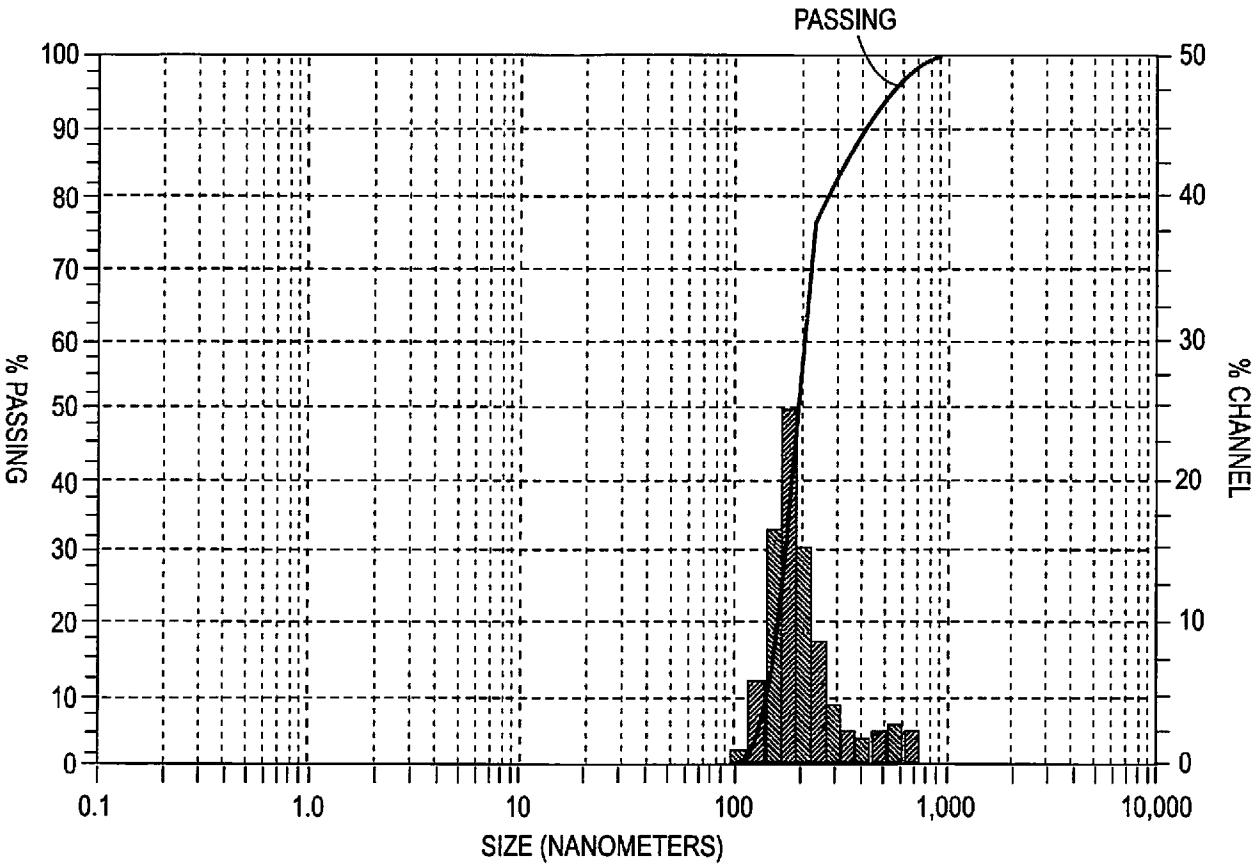
FIG. 2 is a graph depicting particle size distribution for the latex produced in accordance with Example 2 of the present disclosure.

An extruder, equipped with a feed hopper, a twin screw feeder, and liquid injection ports operated at a specified barrel temperature profile of 180/260/260/260/190/190/190/200/200/203/203 over its 12 sections and was set to a rotor speed of about 450 rpm. About 6 kilograms of an ethoxylated bisphenol-A based amorphous polyester resin was loaded into the hopper of the screw feeder which delivered about 380 grams/minute of the resin powder to the extruder. About 120 grams of Tris was loaded into the hopper of a small twin-screw feeder and added into the polyester resin at a rate of about 455 grams/hour (about 7.6 grams/minute). As the material traveled down the screw feeder, it melted and neutralization of the resin acid end groups by Tris took place. Thereafter, about 2.5 kilograms of DOWFAX™ 2A1, an alkyldiphenyloxide disulfonate from The Dow Chemical Company in solution (about 47% solids content), preheated to a temperature of about 90° C., was added to the resin mixture at a rate of about 113 grams/minute. As the melted mixture traveled down the extruder, DIW was added at three subsequent ports. The DIW was preheated to a temperature of about 90° C. and injected into the extruder at a rate of about 165 grams/minute, about 274 grams/minute, and about 110 grams/minute, respectively. The product from the extruder included a stream of latex that was collected and diluted with a fixed amount of DIW in a small pail with gentle agitation. The particle size for the latex produced was about 197 nm with a volume of about 90% and about 632 nm with volume of about 10%, as shown in FIG. 2.

A control was prepared using sodium hydroxide (NaOH) as the meutalization agent.

Table 2 lists the molecular weights of the resins processed with solvent-free extrusion using NaOH or Tris. The sample prepared with Tris showed a higher molecular weight with less degradation compared to that with NaOH. The molecular weights of the raw resin (before the emulsification) are listed in the table.

TABLE 2

Comparison of resin molecular weights prior to and following emulsification in solvent-free extrusion process using NaOH or Tris

| | Neutralizing | Molecular Weight (kg/mol) | | % Degraded | |
|---|---|---|---|---|---|
| | Agent | Mw | Mn | on Mw | on Mn |
| Raw resin lot#2 | Not applicable | 129.5 | 5.3 | 0 | 0 |
| Control sample | NaOH | 54.0 | 4.2 | 58 | 21 |
| Example 2 | Tris | 66.4 | 5.4 | 49 | 0 |

Example 3

Aggregation and coalescence process utilizing a solvent-based latex emulsion neutralized by Tris in lieu of a solvent-based latex emulsion neutralized by ammonium hydroxide to produce a cyan toner.

About 162 grams of an amorphous polyester emulsion made with Tris from Example 1 (about 25.65% by weight), about 121 grams of an amorphous polyester emulsion (about 35.15% by weight), about 35 grams of a crystalline polyester emulsion (about 35.42% by weight), about 0.9 grams of DOWFAX™ 2A1 anionic surfactant, about 58 grams of cyan pigment blue15:3 (PB15:3) in a dispersion (commercially available from Sun Chemical) and about 51 grams of polyethylene wax (commercially available from IGI) were charged into a 2 Liter plastic beaker and mixed. The slurry mixture was pH adjusted to about 4.2 with 0.3M nitric acid. Then the whole toner slurry was homogenized using a portable Turrex homogenizer probe at about 3000 to about 4000 rpm for about 5 minutes. A small amount of aluminum sulfate flocculent was also added during the homogenization process. The resulting thick toner slurry was charged into a 2 liter Buchi stainless steel reactor installed with a mechanical agitator and equipped with a double impeller.

The mixture was agitated at about 460 rpm and heated to about 44° C. for the toner aggregation process. The toner particle growth and size were then monitored closely with a Coulter Counter until the particle size was approximately 4.6 microns. Then, about 157 grams of the same amorphous emulsions as used in the core was added as a "shell" and the mixture was heated to about 48° C.

The toner particle growth process was then stopped once the target particle size measured about 5.5 microns, by adding a combination of pH 9 Tris-HCl buffer solution and 4% NaOH to raise the toner slurry pH to about 7.8. During the freezing step, about 12.4 grams of pH 9 TRIS-HCl buffer was added to reach a pH of about 4.5 to about 5.6. Then, about 6.35 grams of EDTA mixed with about 38 grams of water was added; followed by the addition of about 10 grams of 4% NaOH to adjust the pH of from about 7.7 to about 7.9. The process proceeded to coalesce at elevated temperatures above the Tg of the toner resins (from about 50° C. to about 95° C.). Once the temperature reached about 85° C., the toner slurry pH was reduced using pH 5.7 buffer to achieve a particle circularity of ≥about 0.965. The entire process from raw material preparation, to homogenization, aggregation and coalescence, took approximately 7 to 8 hours for completion. When the desired toner particle size was obtained, the toner slurry was quenched and discharged from the 2 liter reactor.

The emulsion aggregation/coalescence process produced polyester toner particles of about 5.61 microns with a volume Geometric Size Distribution ($GSD_v$) of about 1.26, a number Geometric Size Distribution (GSDn) of about 1.27, and a circularity of about 0.965. The final solid particles were filtered, followed by sieve separation (about 25 μm) and washed at room temperature prior to the drying process.

The resulting toner particles were submitted for amine testing. The amount of Tris in the toner particles was about 450 μg and was detected by HPLC (see Table 3 below).

Example 4

Aggregation and coalescence process, utilizing a solvent-free latex emulsion neutralized by Tris in lieu of a solvent-free latex emulsion neutralized by NaOH, to produce a cyan toner.

About 233 grams of an amorphous polyester emulsion made with Tris and about 14 pph surfactant (about 20.41% by weight), about 108 grams of an amorphous emulsion (about 38.5% by weight), about 37 grams of a crystalline polyester emulsion (about 30.48% by weight), about 58 grams of cyan pigment PB15:3 dispersion, and about 51 grams of polyethylene wax were charged into a 2 liter plastic beaker and mixed. The slurry mixture was pH adjusted to about 4.2 with 0.3M nitric acid. The resulting toner slurry was charged into a 2 liter Buchi stainless steel reactor at a bath temperature of about 5° C. installed with a mechanical agitator and equipped with a double impeller. The mixture was agitated at about 300 rpm for about 5 minutes while a small amount of aluminum sulfate flocculent was added.

Thereafter, the entire contents were heated to about 44° C. and the mixing was increased to about 460 rpm for the toner aggregation process. The toner particle growth and size were then monitored closely with a Coulter Counter until the particle size was approximately 4.6 microns. Then, about 189 grams of the same amorphous polyester emulsions as used in the core were added as a "shell" and the mixture was further heated to about 53° C.

The toner particle growth process was then stopped (sometimes referred to as "freezing") once the target particle size measured about 5.5 microns, by adding 4% NaOH to raise the final toner slurry pH to about 7.8. During the freezing step, a solution of about 6.35 grams of EDTA and about 38 grams of water was added when the pH reached about 4.5 followed by the addition of about 19 grams of 4% NaOH to reach a final pH of about 7.8. The process proceeded to coalesce at elevated temperatures above the Tg of the toner resins (from about 50° C. to about 95° C.). Once the temperature reached about 85° C., the toner slurry pH was reduced using pH 5.7 buffer to achieve a particle circularity of ≥about 0.965. The entire process, from raw material preparation, to aggregation and coalescence, took approximately 7 to 8 hours for completion. When the desired toner particle size was obtained, the toner slurry was quenched and discharged from the 2 liter reactor.

The emulsion aggregation/coalescence process produced polyester toner particles of about 8.41 microns, with a $GSD_v$ of about 1.31, a GSDn of about 1.41, and a circularity of about 0.955. The final solid particles were filtered, followed by sieve separation (about 25 μm) and washed at room temperature prior to the drying process.

The resulting toner particles were submitted for amine testing. The amount of Tris in the toner particles was about 700 μg and was detected by HPLC (see Table 3).

Table 3 illustrates various examples of toners prepared with emulsions that contained Tris, either added during the phase inversion process or solvent-free process or added after the emulsion was made.

TABLE 3

| Amine Analysis | | | | | | |
|---|---|---|---|---|---|---|
| Toner sample I.D | Tris in amorphous polyester emulsion (pph) | Tris in A/C (ppm) | Tris in dry toner slurry (ppm) | Tris detected by HPLC (μG) | Fusing & Charging | Note |
| Control | 0 | 0 | 0 | <<100 | acceptable | Tris not detectable |
| Comparative Toner | 0 | 25503 | 25503 | 1000 | acceptable | frozen using Tris buffer |
| Example 3 | 2.5 | 0 | 9825 | 450 | N/A | Toner with solvent-based emulsion with 2.5 pph Tris |
| Example 4 | 2.0 | 0 | 7860 | 700 | N/A | Toner with solvent-free emulsion with 2.0 pph Tris |

The control toner was prepared without Tris. The comparative toner was prepared with non-Tris emulsions. However, 40 grams of a Tris-based buffer solution was utilized during the aggregation/coalescence step for freezing the toner. The comparative toner contained the highest levels of Tris in the final toner at 1000 μG, as detected by HPLC. Even with this level of Tris in the toner (which is considered "trace amounts") no changes were seen in the toner fusing and charging compared to the control toner. In addition, analytical testing indicated that any Tris detected in the toners solely resided inside the particle and not on the particle surface. Thus, the Tris neutralizing agent was effectively washed from the toner particle surface.

As indicated above in Example 3 and Table 3, the sample of Example 3 was prepared with an emulsion utilizing 2.5 pph of Tris during the phase inversion process and was determined to contain 450 μG of Tris in the resultant toner. As indicated above in Example 4 and Table 3, the sample of Example 4 was prepared by adding 2.0 pph of Tris into one of the toner emulsions emulsified using a solvent-free extrusion process and was determined to contain 700 μG of Tris in the resultant toner.

Thus, it appears that the Tris remaining in the final toner, at levels of less than 1000 μG, did not affect the fusing and charging performance. Furthermore, the added Tris during the emulsification process was traced in the final toner particles by HPLC. As a result, a trace amount of Tris existing inside toner particles detectable by HPLC could facilitate monitoring and controlling toner performance and properties.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

contacting at least one polyester resin with least one organic solvent and a phase inversion agent to form a resin mixture;

neutralizing said at least one polyester resin with a tris (hydroxymethyl) aminomethane (Tris);

adding water to the mixture to provide a latex emulsion containing latex particles; and continuously recovering the latex particles.

2. The process according to claim 1, wherein the at least one polyester resin is selected from the group consisting of amorphous resins, crystalline resins, and combinations thereof.

3. The process according to claim 1, wherein the at least one organic solvent and the phase inversion agent is selected from the group consisting of alcohols, esters, ethers, ketones, amines, and combinations thereof, in an amount of from about 0.1% by weight to about 99% by weight of the polyester resin.

4. The process according to claim 1, wherein adding the water occurs at temperatures of from about 25° C. to about 140° C.

5. The process according to claim 1, wherein the polyester resin is a resin having a number average molecular weight of from about 1,000 to about 50,000, a weight average molecular weight of from about 2,000 to about 150,000, and a molecular weight distribution of from about 1.5 to about 50.

6. The process according to claim 1, wherein the Tris is present in an amount from about 0.001% to 50% by weight of the resin and is added at a rate of from about 0.4 grams/minute to about 400 kilograms/minute.

7. The process according to claim 1, wherein the latex particles have a particle size of about 30 nanometers to about 500 nanometers.

8. A process for preparing a polyester emulsion comprising:

contacting at least one polyester resin with a tris(hydroxymethyl) aminomethane (Tris) in the absence of an organic solvent to form a mixture;

melt mixing the mixture;

adding a concentrated surfactant to the mixture;

adding water to the mixture to provide a latex emulsion containing latex particles;

optionally adding one or more additional ingredients of a toner composition to the mixture; and continuously recovering the latex particles.

9. The process according to claim 8, wherein the Tris is present in an amount from about 0.001% to 50% by weight of the resin and is added at a rate of from about 0.4 grams/minute to about 400 kilograms/minute.

10. The process according to claim 8, wherein melt mixing occurs at a temperature of from about 25° C. to about 300° C. and at a rate of from about 10 rpm to about 5,000 rpm, and wherein adding the water occurs at a temperature of from about 25° C. to about 140° C.

11. The process according to claim 8, wherein the polyester resin is a resin having a number average molecular weight of from about 1,000 to about 50,000, a weight average molecular weight of from about 2,000 to about 150,000, and a molecular weight distribution of from about 1.5 to about 50.

12. The process according to claim 8, wherein the surfactant is selected from the group consisting of anionic surfactants, ionic surfactants, nonionic surfactants, cationic surfactants, and combinations thereof, and the surfactant is present in an amount from about 0.01% to about 20% by weight of the resin.

13. The process according to claim 8, wherein the water is added to the resin mixture at a rate of about 10 grams/minute to about 10 kilograms/minute.

14. A toner comprising:

at least one polyester resin neutralized with a tris(hydroxymethyl) aminomethane; and optionally one or more additional ingredients of a toner composition.

15. The toner according to claim 14, wherein the at least one polyester resin is selected from the group consisting of amorphous resins, crystalline resins, and combinations thereof.

16. The toner according to claim 14, wherein the toner has a particle size of from about 2 microns to about 10 microns.

17. The toner according to claim 14, wherein the toner has a volume average particle size distribution index of from about 1 to about 1.8, and a circularity of from about 0.6 to about 1.

18. The toner according to claim 14, wherein the polyester resin is a resin having a number average molecular weight of from about 1,000 to about 50,000, a weight average molecular weight of from about 2,000 to about 150,000, and a molecular weight distribution Mw/Mn of from about 1.5 to about 50.

* * * * *